US006561199B2

(12) United States Patent
Gleeson et al.

(10) Patent No.: US 6,561,199 B2
(45) Date of Patent: May 13, 2003

(54) CLEANING APPARATUS ESPECIALLY ADAPTED FOR CLEANING VESSELS USED FOR SANITARY PRODUCTS, AND METHOD OF USING SAME

(75) Inventors: Bentley F. Gleeson, Plymouth Meeting, PA (US); Andrew K Delaney, West Chester, PA (US); Minh Quang Le, Fairfax, VA (US); Robert E. Delaney, Devon, PA (US)

(73) Assignee: Gamajet Cleaning Systems, Inc., Malvern, PA (US)

( * ) Notice: Subject to any disclaimer, the term of this patent is extended or adjusted under 35 U.S.C. 154(b) by 36 days.

(21) Appl. No.: 09/870,963

(22) Filed: May 31, 2001

(65) Prior Publication Data

US 2002/0179118 A1 Dec. 5, 2002

(51) Int. Cl.[7] ..... B08B 9/093; B05B 3/00

(52) U.S. Cl. ..... 134/22.18; 134/24; 134/167 R; 239/227; 239/240; 239/246

(58) Field of Search ..... 134/22.18, 24, 134/167 R, 180, 181; 239/263, 263.3, 227, 240, 246

(56) References Cited

U.S. PATENT DOCUMENTS

| | | | | |
|---|---|---|---|---|
| 2,955,764 | A | 10/1960 | Hruby, Jr. | 239/206 |
| 3,131,867 | A | 5/1964 | Miller et al. | 239/97 |
| 3,275,241 | A | 9/1966 | Saad | 239/227 |
| 3,326,468 | A | 6/1967 | Bristow et al. | 239/227 |
| 3,334,817 | A | 8/1967 | Miller et al. | 239/113 |
| 3,464,632 | A | 9/1969 | Bristow | 239/227 |
| 3,496,949 | A | 2/1970 | Mercer | 134/179 |
| 3,526,363 | A | 9/1970 | Hauser | 239/206 |
| 3,584,790 | A | 6/1971 | Bonfield | 239/227 |
| 3,637,138 | A | 1/1972 | Rucker | 229/227 |
| 3,791,583 | A | 2/1974 | Nunlist et al. | 239/227 |
| 3,834,625 | A | 9/1974 | Barthod-Malat | 239/227 |
| 3,874,594 | A | 4/1975 | Hatley | 239/227 |
| 3,885,740 | A | 5/1975 | Sugino et al. | 239/227 |
| 3,902,670 | A | 9/1975 | Koller et al. | 239/227 |
| 3,910,499 | A | 10/1975 | Trouilhet | 239/228 |
| 4,214,705 | A | 7/1980 | Watts et al. | 239/227 |
| 4,244,524 | A | 1/1981 | Wellings | 239/227 |
| 4,351,478 | A | 9/1982 | Loooper | 239/227 |
| 4,353,507 | A | 10/1982 | Kah, Jr. | 239/240 |
| 4,501,391 | A | 2/1985 | Hunter | 239/97 |
| 4,662,565 | A | 5/1987 | Waldrum | 239/236 |

(List continued on next page.)

OTHER PUBLICATIONS

GAMAJET® IV Reference Guide, Sybron Chemicals, Inc./ Gamajet Equipment Division, First Edition, Nov. 1992.
Sellers Cleaning Systems, ORBI–3™ Masters Limited Access Tank Cleaning Challenges, Bulletin S–03–294, 1994.
Maxon Precision Motors Catalog, Apr. 1994, p. 101.

*Primary Examiner*—Randy Gulakowski
*Assistant Examiner*—Saeed Chaudhry
(74) *Attorney, Agent, or Firm*—Woodcock Washburn LLP

(57) ABSTRACT

An apparatus for cleaning the interior of a vessel for containing a sanitary product by ejecting a rotating stream of cleaning fluid. The apparatus features a stationary housing that forms an inlet for receiving a flow of cleaning fluid, a rotatable housing mounted for rotation on the stationary housing about a first axis, and a nozzle for ejecting the cleaning fluid, the nozzle being rotatably mounted on the rotatable housing so that the nozzle rotates about a second axis. A planetary gear train is driven by an impeller driven by the flow of cleaning fluid and drives the rotation of the rotatable housing. The planetary gear train is located between the apparatus inlet and the nozzle. A portion of the flow of cleaning fluid received by the inlet is diverted so as to flow through a passage through the planetary gear train so that the planetary gear train is cooled and lubricated without the use of oil-based or other lubricants unsuitable for contact with sanitary products that might contaminate the cleaning fluid.

18 Claims, 6 Drawing Sheets

U.S. PATENT DOCUMENTS

| | | | | |
|---|---|---|---|---|
| 4,664,720 | A | | 5/1987 | Rucker ..... 134/22.1 |
| 4,708,290 | A | | 11/1987 | Osmond ..... 239/227 |
| 4,783,004 | A | | 11/1988 | Lockwood ..... 239/205 |
| 4,798,334 | A | | 1/1989 | Harrington ..... 239/227 |
| 4,842,201 | A | | 6/1989 | Hunter ..... 239/396 |
| 4,867,379 | A | | 9/1989 | Hunter ..... 239/240 |
| 4,967,961 | A | | 11/1990 | Hunter ..... 239/240 |
| 5,012,796 | A | | 5/1991 | Loberg ..... 239/227 |
| 5,056,716 | A | | 10/1991 | Robinson ..... 239/227 |
| 5,092,523 | A | | 3/1992 | Rucker et al. ..... 239/240 |
| 5,169,069 | A | | 12/1992 | Rucker et al. ..... 239/227 |
| 5,172,710 | A | | 12/1992 | Harrington ..... 134/167 R |
| 5,263,906 | A | | 11/1993 | Antonov ..... 74/337 X |
| 5,316,218 | A | | 5/1994 | Bowen ..... 239/246 |
| 5,332,155 | A | | 7/1994 | Jager ..... 239/240 |
| 5,640,983 | A | | 6/1997 | Sherman, Jr. et al. .. 134/167 R |
| 5,718,382 | A | | 2/1998 | Jaeger ..... 239/227 |
| 5,954,271 | A | * | 9/1999 | Le ..... 239/227 |
| 6,123,271 | A | | 9/2000 | Delaney et al. ..... 239/227 |
| 6,460,553 | B1 | * | 10/2002 | Owens et al. ..... 134/167 R |

* cited by examiner

FIG. 1
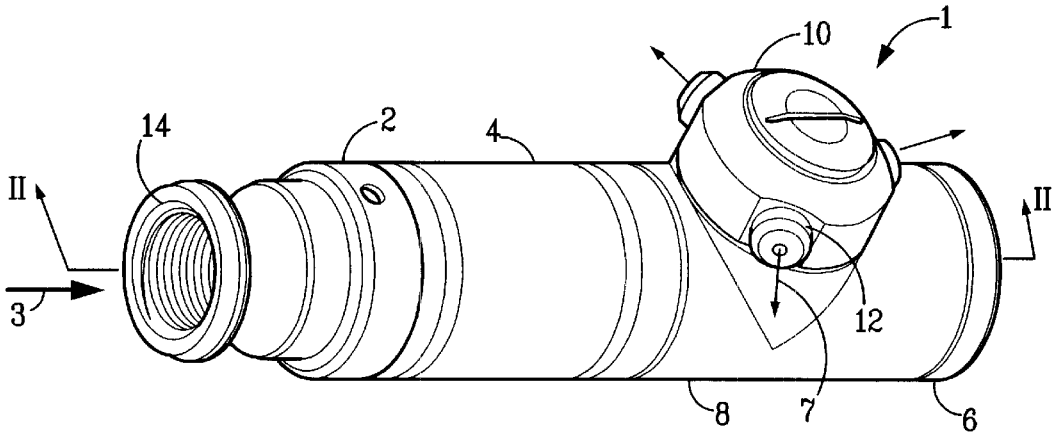
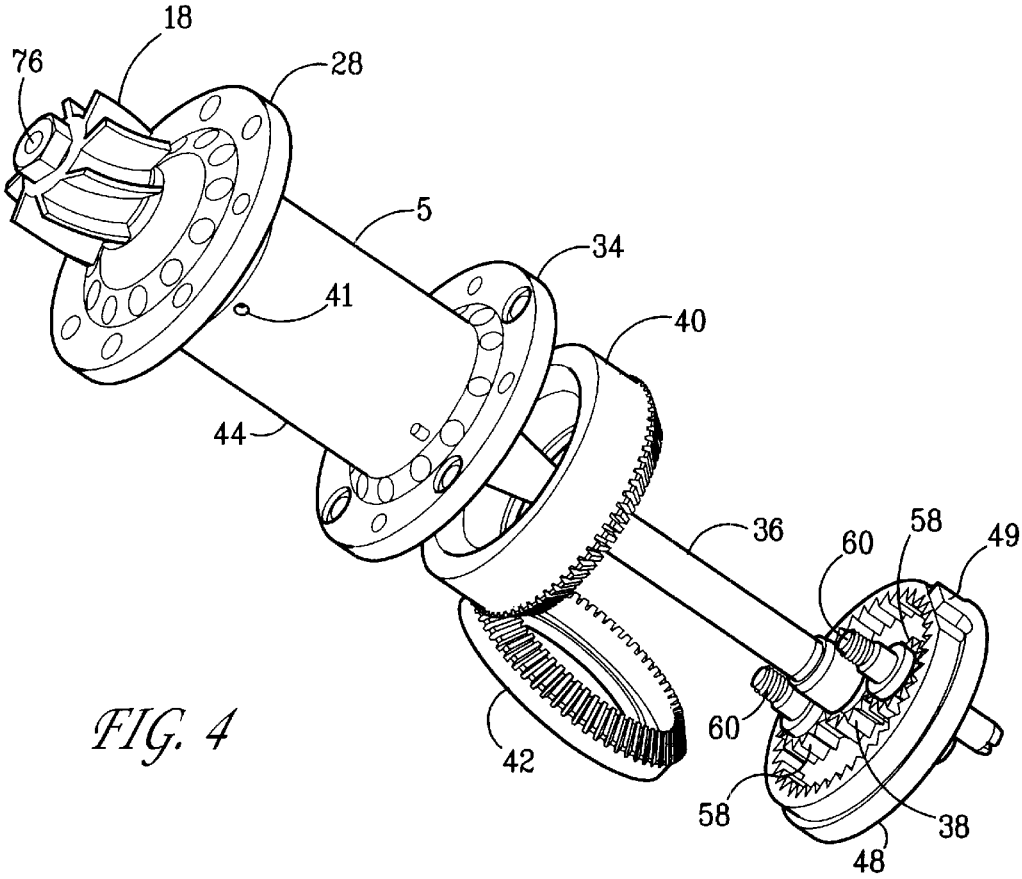
FIG. 4

CLEANING APPARATUS ESPECIALLY ADAPTED FOR CLEANING VESSELS USED FOR SANITARY PRODUCTS, AND METHOD OF USING SAME

FIELD OF THE INVENTION

The present invention relates to an apparatus and method for cleaning vessels, such as tanks and barrels, using a pressurized fluid stream. More specifically, the present invention relates to a vessel cleaning apparatus and method that is especially well suited to cleaning vessels that cannot be contaminated with oil or other lubricants, such as a vessel used for processing sanitary products.

BACKGROUND OF THE INVENTION

Vessels, such as tanks, are frequently cleaned by inserting a cleaning machine, which is supplied with heated, pressurized cleaning fluid, through a access port in the vessel. The cleaning machine ejects the cleaning fluid as a high velocity jet that scours the inside walls of the tank so as to effect a cleaning action. In order to obtain as wide a coverage as possible, such cleaning apparatus frequently employ rotating nozzles that sweep around as they eject the cleaning fluid. Cleaning apparatus sold by Gamajet Cleaning Services, Inc., assignee of the current invention, achieve almost 360° coverage by rotating the nozzles around two mutually perpendicular axes. In such apparatus, the rotation of the nozzles is driven by a gear train that is, in turn, driven by the incoming flow of cleaning fluid via an impeller connected to the drive shaft for the gear train. Consequently, such apparatus are sometimes referred to as fluid powered, gear driven tank cleaning machines.

One early version of a fluid powered, gear driven tank cleaning machine, known commercially as the Gamajet III, is shown in U.S. Pat. No. 3,637,138 (Rucker). In the late 1980's, Gamajet introduced the Gamajet IV cleaning machine, shown in U.S. Pat. No. 5,012,976 (Loberg), which had a relatively large maximum flow rate of 300 GPM. Like the Gamajet III, the Gamajet IV featured a gear train that comprised numerous stages of pinion and spurs gears that ultimately drove a ring gear fixed on a rotating T-housing assembly so as to cause rotation of the nozzles assembly about the first axis. A bevel gear fixed on the nozzle assembly mated with a bevel gear fixed on a stem housing, which remains stationary, so that rotation of the nozzle assembly about the first axis caused rotation of the nozzles about the second axis. The fluid inlet was formed at one end of the machine, while the gear train was disposed at the other end of the machine. The rotating nozzle assembly was disposed between the inlet and the gear train. The gear train was lubricated by the cleaning fluid flowing through the machine.

In order to enable the impeller to operate at an efficient speed without causing the nozzles to spin too quickly, which can result in the production of a mist rather than a strong jet, the gear trains of fluid powered, gear driven tank cleaning machines must be capable of high speed reduction. In both the Gamajet III and IV, this high speed reduction was achieved by means of a number of successive stages of spur and pinion gears. In each stage, a small input pinion gear turns a large output spur gear, thereby causing an incremental speed reduction. The output spur gear of that stage is connected to a small input pinon gear of the next stage, and so on. Unfortunately, this approach results in a relatively large gear train. Thus, the gear box of the Gamajet IV is over four inches in diameter. When combined with the nozzle housing, the width of the machine is about 6 inches so that the minimum entry opening for the machine is over 6inches. Consequently, such machines cannot be used in some applications, such as small tanks, which feature relatively small entry ports. Moreover, Gamajet IV machines were relatively heavy, approximately 30 lbs, making their manipulation during installation and use difficult.

In 1994, Gamajet introduced the Gamajet V tank cleaning machine, which is shown in U.S. Pat. No. 5,954,271 (Minh et al.). As a result of its configuration, the gear train of the Gamajet V is housed in a gear box having a diameter of only approximately 2 inches. This is only one-half the diameter of the Gamajet IV gearbox. As a result of the reduced size of the gear box, together with the use of a compact nozzle housing, the Gamajet V can be easily inserted into a 3 inch diameter access port. In addition, the Gamajet V is relatively light weight, weighing only about 7 lbs. The gear train of the Gamajet V featured three stages of gears rotating within a rotating cylindrical ring gear. The fiat and second stages are planetary gears, while the third stage are stationary gears. A first pinion gear, which is driven by the impeller shaft, drives the first stage of planetary gears. The first stage of planetary gears drives a second pinion gear that then drives the second stage of planetary gears. The second stage of planetary gears drives a third pinion gear that then drives the stationary third stage of gears. The stationary gears of the third stage drive the cylindrical ring gear. The cylindrical ring gear drives a pinion gear that, via idler gears, drives the ring gear that rotates the nozzle assembly. As in the Gamajet IV, the fluid inlet of the Gamajet V was formed at one end of the machine, the gear train was disposed at the other end of the machine, and the rotating nozzle assembly was disposed between the inlet and the gear train. The planetary gear train is lubricated by grease and mounted in a sealed housing to minimize contamination of the cleaning fluid by the grease. Nevertheless, gear box leakage can still occur if the seals are compromised. Still later, Gamajet developed a tank cleaning machine, which is shown in U.S. Pat. No. 6,123,271 (Delaney et al.), hereby incorporated by reference in its entirety, that located the planetary gear train between the inlet and the rotating outlet nozzles and improved the sealing of the gear train.

Despite the improvements in gear train sealing, the possibility of contamination of the cleaning fluid, and consequently the vessel being cleaned, with lubricants used within the gear train have limited the use of such cleaning machines in vessels used to process sanitary products in which lubricant contamination cannot be tolerated, such as food, beverages, pharmaceuticals, and personal care products such as shampoo. Consequently, in the past, vessels used for sanitary products that would otherwise have been ideal candidates for cleaning by compact planetary gear driven tank cleaning machines have instead been cleaned by machines that did not require gear trains and, consequently did not require lubrication, such as a non-rotating ball type cleaning apparatus, with numerous discharge nozzles formed about the circumference of a ball. However, such non-rotating apparatus cannot clean as effectively as the planetary gear train driven cleaning machines discussed above.

Consequently, it would be desirable developed a planetary gear driven tank cleaning machine that did not require the use of any lubricants, including lubricants in the planetary gear train, that might contaminate the cleaning fluid.

SUMMARY OF THE INVENTION

It is an object of the current invention to provide an improved cleaning machine for cleaning the inside of vessels. This and other objects are achieved in an apparatus for cleaning the interior of a vessel by ejecting a rotating stream of cleaning fluid, comprising (i) a first fluid inlet for receiving the cleaning fluid, (ii) a rotatable housing mounted for rotation about a first axis, (iii) a nozzle having a first fluid outlet for ejecting the cleaning fluid received by the first fluid inlet, the nozzle rotatably mounted on the rotatable housing so that the nozzle rotates about a second axis, a first fluid passage placing the first fluid inlet in fluid flow communication with the first fluid outlet, (iv) an input shaft driven by the fluid received by the first fluid inlet, (v) a planetary gear train comprising a sun gear and at least one planetary gear mounted for rotation about the sun gear, the planetary gear train driven by the input shaft, the planetary gear train driving the rotatable housing to rotate about the first axis, (vi) a housing at least partially enclosing the planetary gear train, a second fluid passage formed within the housing, the sun gear and the planetary gear disposed within the second fluid passage, the second fluid passage having a second fluid inlet and a second fluid outlet that together place the second fluid passage in flow communication with the first fluid passage, wherein at least a portion of the cleaning fluid received by the first fluid inlet flows through a portion of the first fluid passage and then flows into the second fluid inlet and then flows through the second fluid passage so as to flow over the sun gear and the planetary gear and then flows through the second fluid outlet so as to reenter the first fluid passage and then flows through the first fluid outlet.

The current invention also encompasses a method of cleaning a vessel suitable for containing a sanitary product, comprising the steps of (i) introducing a cleaning machine into the vessel, (ii) introducing a flow of cleaning fluid into an inlet of the cleaning machine, (iii) rotating an impeller by directing the cleaning fluid to flow over the impeller so that the impeller drives rotation of a planetary gear train, the planetary gear train driving rotation of a rotatable body housing about a first axis, the rotatable body housing driving rotation of a rotatable nozzle housing about a second axis, (v) directing the flow of cleaning fluid received by the inlet through a passage to a nozzle mounted on the rotatable nozzle housing so that the nozzle rotates with the rotatable nozzle housing, (vi) ejecting the cleaning fluid from the nozzle, (vii) cooling and lubricating the planetary gear train by diverting a portion of the flow of cleaning fluid from the passage so as to cause the portion of the cleaning fluid to flow through the planetary gear train and then reintroducing the portion of the cleaning fluid back into the passage so that the reintroduced portion of the cleaning fluid is then ejected from the nozzle.

BRIEF DESCRIPTION OF THE DRAWINGS

FIG. 1 is an isometric view of a vessel cleaning machine according to the current invention.

FIG. 4 is an isometric view of the drive train of the cleaning machine shown in FIG. 1.

FIG. 7(*a*) is a view similar to FIG. 7 but with the planetary gears deleted from the upper half of the cross-section to better illustrate the flow path of cleaning fluid through the planetary gear train.

DESCRIPTION OF THE PREFERRED EMBODIMENT

Figure 2:
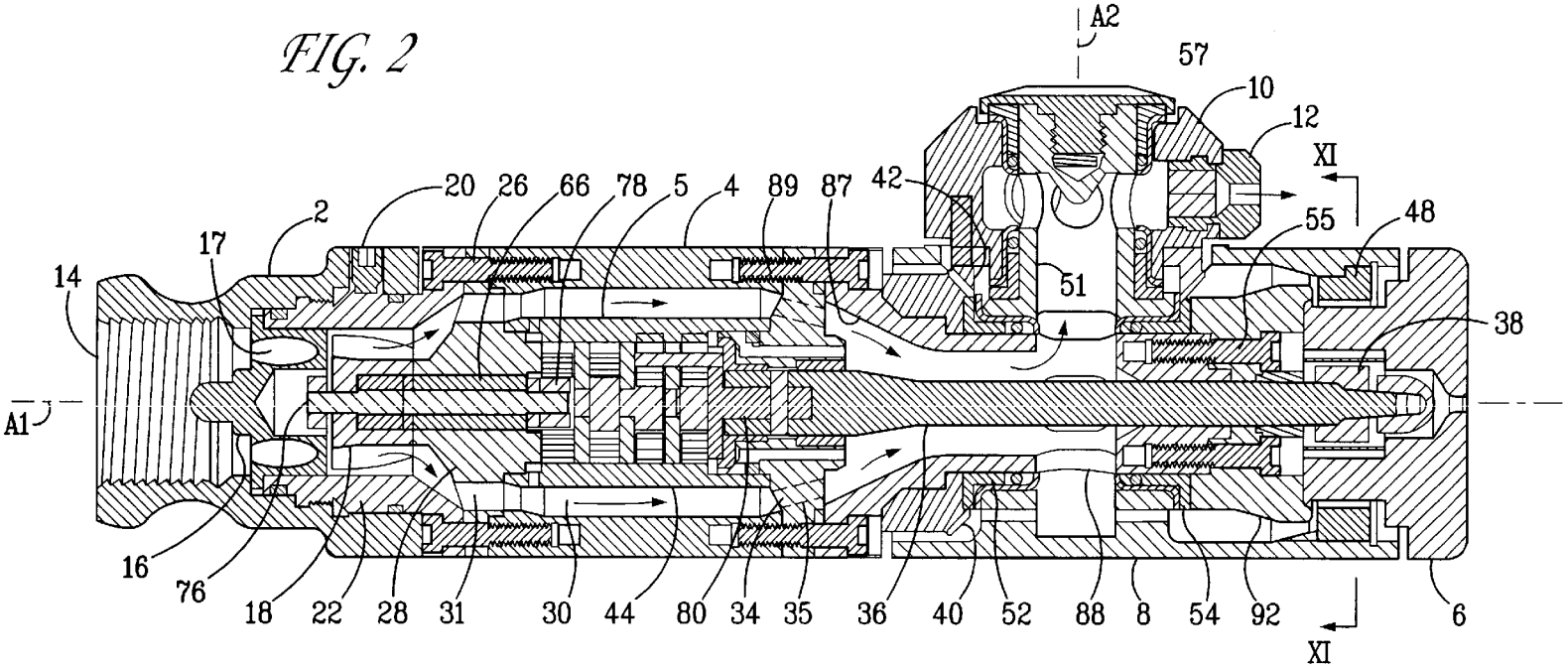
FIG. 2 is a longitudinal cross-section of the cleaning machine shown in FIG. 1 taken along line II—II shown in FIG. 1.
Figure 5:
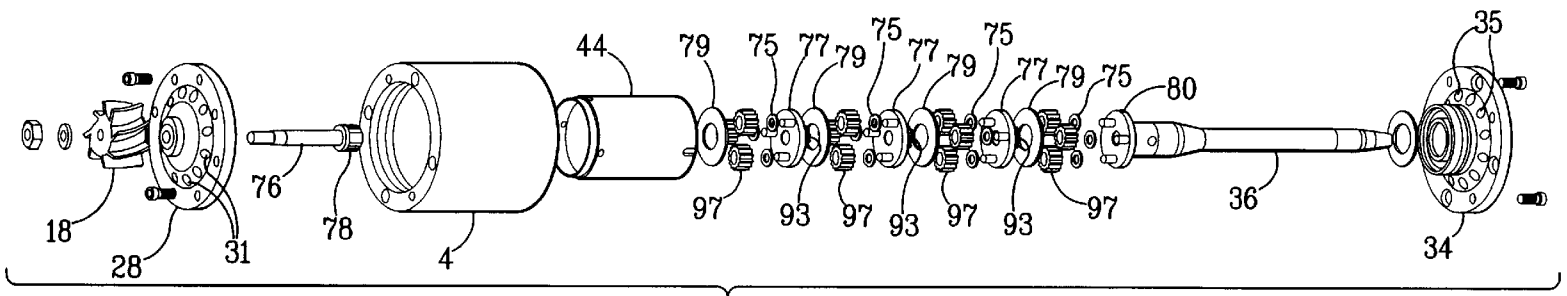
FIG. 5 is an exploded view of the planetary gear train portion of the drive train assembly shown in FIG. 4.
Figure 3:
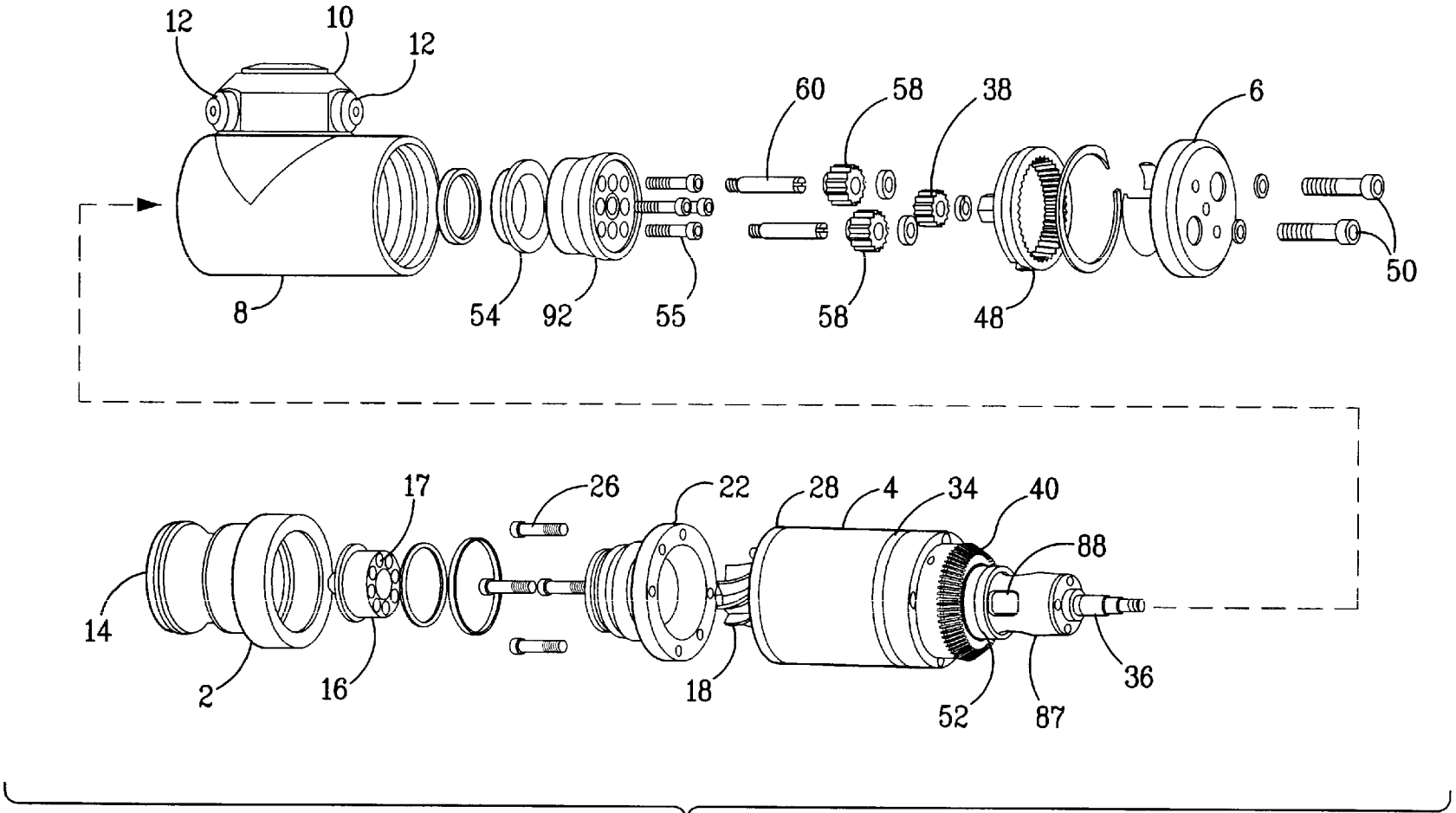
FIG. 3 is an exploded view of the cleaning machine shown in FIG. 1.
Figure 6:
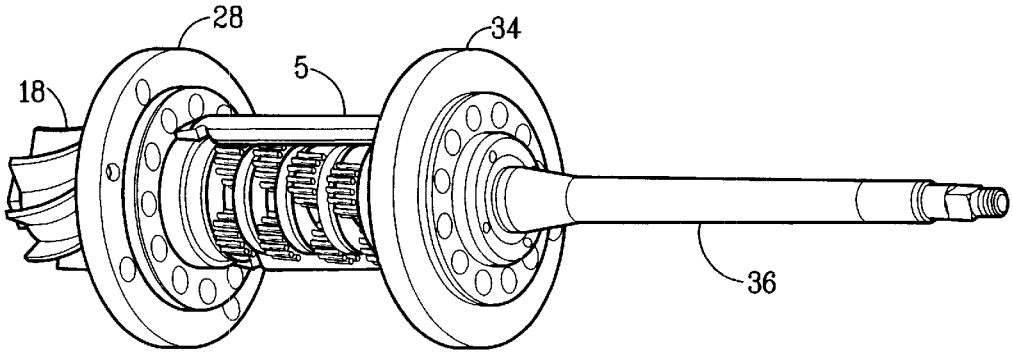
FIG. 6 is an isometric view, partially cut away, of the planetary gear train portion of the drive train assembly shown in FIG. 4.

A vessel cleaning machine 1 according to the current invention is shown in FIG. 1. The cleaning machine 1 is primarily comprised of a stationary structure and a rotating structure. As shown in FIGS. 1 and 2, the stationary structure is comprised of an inlet housing 2, an upper stem 4 and a base 6. An inlet 14 is formed within the inlet housing 2 and forms one end of the machine. The other end of the machine is formed by the base 6. The rotating structure is comprised of a rotating T-housing 8 and a nozzle housing 10 mounted on the T-housing. Preferably, three spray nozzles 12 are mounted on the nozzle housing 10.

In operation, pressurized cleaning fluid 3 is supplied to the machine inlet 14, for example via a hose threaded into the inlet housing 2. When the apparatus is used to clean a vessel intended for sanitary products, the cleaning fluid is typically water, which may be at ambient temperature or may be heated to a temperature as high as about 190° F. As discussed more fully below, the fluid 3 drives gearing that causes the T-housing 8, including the nozzle housing 10, to rotate about axis Al and causes the nozzle housing to rotate about axis A2, which is preferably perpendicular to axis A1. Eventually, the cleaning fluid 7 is ejected from the spray nozzles 12. Since the nozzles rotate about both axes A1 and A2, the spray pattern they produce provides essentially 360° coverage so as to provide effective cleaning of the vessel walls.

FIGS. 3–11 show the cleaning machine 1 in more detail. The inlet housing 2 is threaded onto the cap 22 of the upper stem 4 and secured by means of a set screw 20. The stem cap 22 is attached by screws 26 to the upper stem 4. The T-housing 8 is mounted on front and rear bearings 52 and 54, respectively. The bearings 52 and 54 are mounted on a stem 87 that is mounted to the upper stem 4 by means of screws 89. This arrangement enables the T-housing 8 to rotate about the centerline of the upper stem 4 and stem 87, which forms the axis A1.

A swirler 16, is mounted within the stem cap 22 and serves to pre-swirl the incoming stream of pressurized cleaning fluid 3. As discussed in aforementioned U.S. Pat. No. 6,123,271, the swirler 16 preferably comprises a disc-shaped body having a number of passages 17. The passages 17 are oriented at an acute angle with respect to the axis A1 that, preferably, is no more than about 30°. The passages 17 swirl the cleaning fluid 3 before it reaches the impeller 18. Alternatively, a stationary vane type swirler could also be used.

After exiting the swirler 16, the cleaning fluid flows over an impeller 18, to which it imparts sufficient torque to rotate an input drive shaft 76 on which the impeller is mounted. The input drive shaft 76 is supported by a front bearing housing 28 in which a bearing containing a tungsten carbide sleeve 66 is press mounted. An input pinion gear 78 mounted on the end of the input drive shaft 76 drives a planetary gear train 5.

Figure 9:
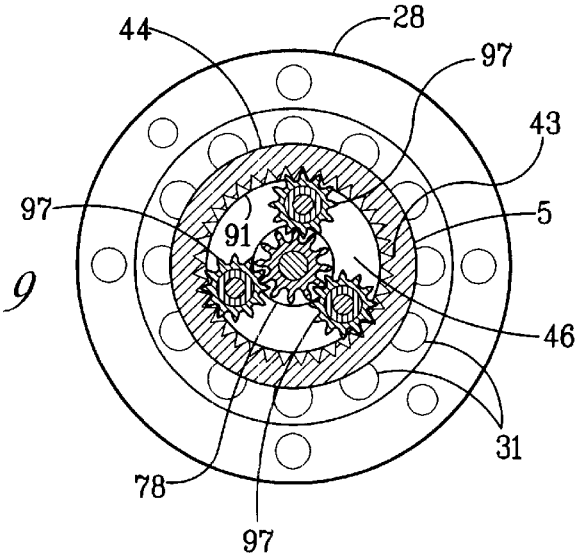
FIG. 9 is a transverse cross-section through the planetary gear train shown in FIG. 7 taken along line IX—IX.
Figure 10:
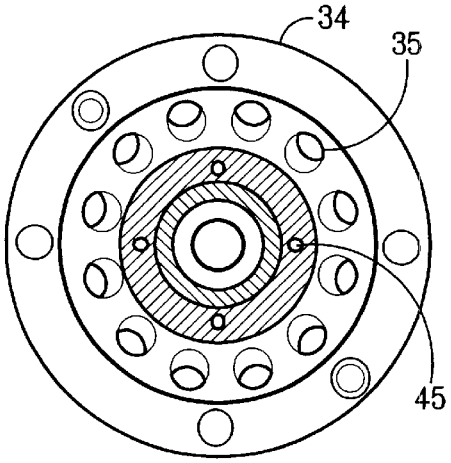
FIG. 10 is a transverse cross-section through rear bearing housing taken along line X—X shown in FIG. 7.

The planetary gear train 5 is enclosed within a housing formed by the front bearing housing 28, a cylindrical ring gear 44, and a rear bearing housing 34. As shown in detail in FIGS. 6–9, the planetary train 5 is comprised of four stages-of planetary gearing, one of which is shown in FIG. 9, and each of which includes three planetary gears 97 that are driven by a sun gear. The sun gear for the first planetary gear stage is formed by the input pinion gear 78 and for the three succeeding stages by gears 93. The sun gears 93 are each affixed to the rear face of a support member 77. The planetary gears are mounted on three shafts that project from the front face of each of the support members 77. Preferably, each planetary gear 97 has a bushing made from carbon filled polyphenylene sulfide. Washers 75 and 79 are disposed on either side of the planetary gears 97. As shown best in FIG. 9, each stage of planetary gears 97 rotate within a cylindrical ring gear 44 having teeth 91 formed on its inside diameter, which causes rotation of the support member 77. The rotation of the support member 77 drives the sun gear 93 of the next stage. The last support member, which is part of the planetary gear train output shaft 80, is connected to an output drive shaft 36, as shown in FIG. 2. Preferably, the speed reduction achieved by the planetary gear train 5 is at least about 250:1, and in one embodiment of the invention is 256:1.

Figure 11:
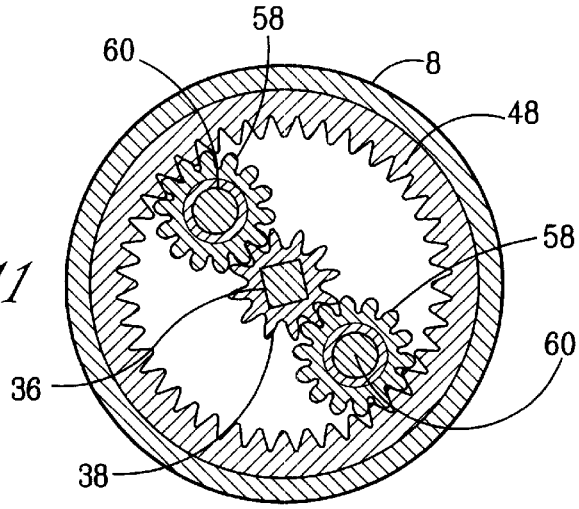
FIG. 11 is a transverse cross-section through the gearing for the T-housing taken along line XI—XI shown in FIG. 2.

The front end of the output drive shaft 36 is supported by the rear bearing housing 34. An output pinion gear 38 is mounted on the end of the output drive shaft 36. As shown best in FIGS. 4 and 11, the output pinion gear 38 drives two idler gears 58 that are supported by shafts 60. The idler gears 58 are not planetary gears and do note rotate about the A1 axis. The shafts 60 extend between an idler shaft base 92 and the base 6. The idler shaft base 92 is secured to the stem 87 by screws 55, while the base 6 is secured to the idler shaft base by means of screws 50. As shown in FIG. 11, the idler gears 58 drive a ring gear 48, retained in the T-housing 8. The ring gear 48 is fixed to the T-housing 8 by means of a key 49 so that rotation of the ring gear 48 drives rotation of the T-housing.

The gearing shown in FIG. 11 results in an additional speed reduction that is preferably at least about 3:1, and is more preferably about 3.33:1, so that, when combined with the planetary gear train 5, the total gear reduction is at least about 750:1, and in one embodiment of the invention is about 850:1. Consequently, the speed of rotation of the T-housing 8 is reduced by a factor of at least about 750:1 compared to the speed of rotation of the impeller 18. This arrangement allows the impeller 18 to turn at high speed in order to derive sufficient energy from the cleaning fluid 3 while allowing the nozzles 12 to turn at sufficiently low speed to effect proper cleaning.

As shown in FIG. 2, a stationary bevel gear 40 is attached to The stem 87. The bevel gear 40 engages a bevel gear 42 fixed to the bottom of the nozzle housing 10. Thus, rotation of the T-housing 8 about axis A1 under the urging of the ring gear 48 and other gearing, shown in FIG. 4, causes the stationary bevel gear 40 to drive the bevel gear 42, thereby causing the nozzle housing 10 to rotate about its axis A2. The gear ratio between the bevel gears 40 and 42 is preferably slightly greater than 1 1 so that each 360° revolution of the T-housing 8 causes the nozzle housing 10 to rotate about 366°.

The flow path of the cleaning fluid 3 through the machine will now be discussed with reference to FIG. 2. Aft flowing over the swirler 16 and the impeller 18, the fluid flows through an annular passage 30. The initial portions of the passage 30 are formed by an annular region created between the stem cap 22 sand the front bearing housing 28 and then by a plurality of holes 31 formed within the front bearing housing 28. The intermediate portions of the passage 30 are fanned by an annular region created between the ring gear 44 and the upper stem 4 and then by holes 35 in the rear bearing housing 34. The final portions of the passage 30 are formed first by an annular region created between The output drive shaft 36 and the stem 87, then by four large openings 88 formed in the stem, then by a nose portion 51 of the T-housing 8, and then by openings 57 in the nose. From the openings 57 in the nose 51, the cleaning fluid 7 flows radially outward through outlets formed in the nozzles 12

Figure 7:
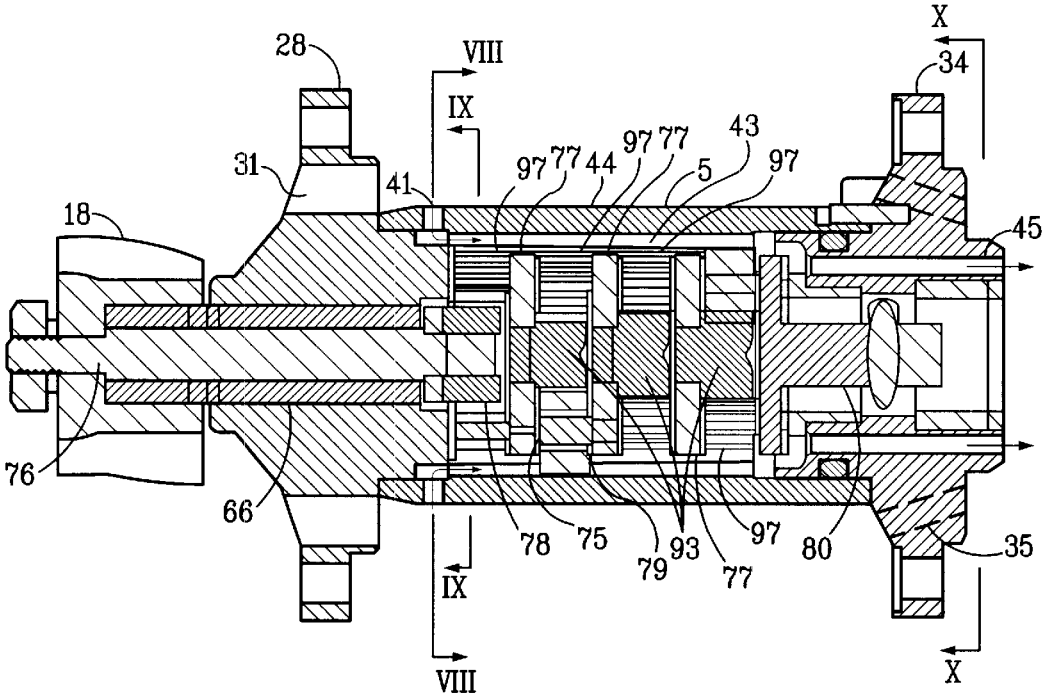
FIG. 7 is a detailed longitudinal cross-section of the planetary gear train shown in FIG. 6.
Figure 7A:
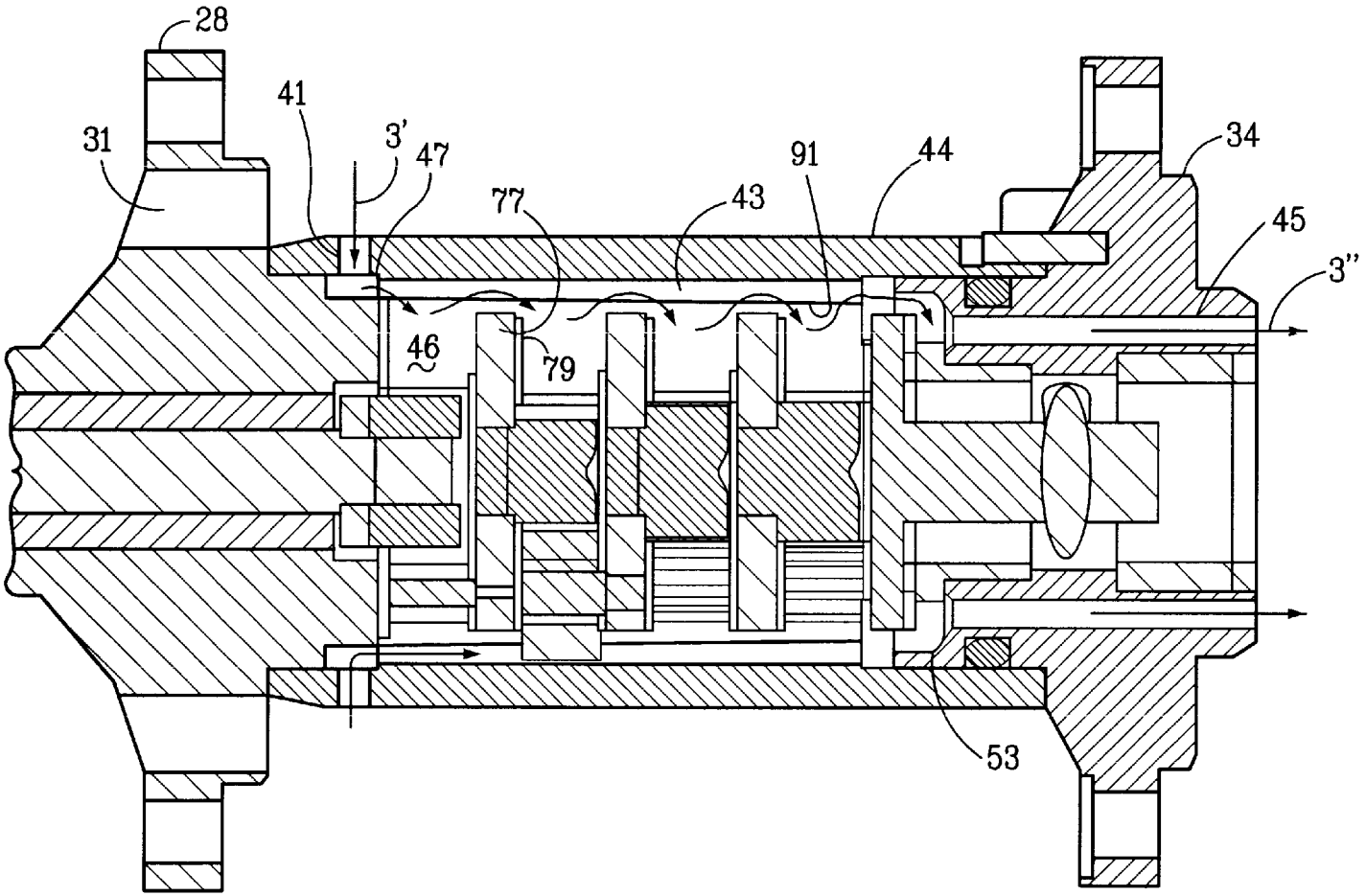
Figure 8:
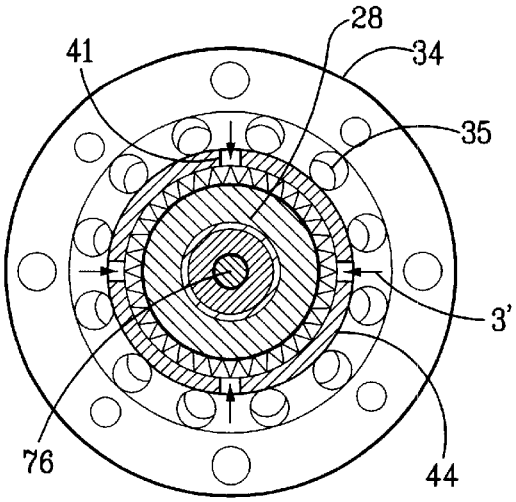
FIG. 8 is a transverse cross-section through the planetary gear train shown in FIG. 7 taken along line VIII—VIII.

As shown best in FIGS. 7(*a*) to 9, according to an important aspect of the current invention, a portion 3' of the cleaning fluid, flow axially through the portion of flaw path 30 disposed in the upper stem 4 is diverted into a series of radially oriented holes 41 formed in the ring gear 44. Few the inlet holes 41, the cleaning fluid 3' continues to flow radially inward to an annular inlet manifold 47 formed by a relief in the rear face of the front bearing housing 28. From the manifold 47 the cleaning fluid 3' flows axially along the valleys 43 formed between the teeth 91 on the inside diameter of 30 the ring gear 44 and then into the space 46 within the ring gear that is between the planetary gears 97 of the first stage of planetary gearing. The cleaning fluid 3' then flows axially from stage to stage of the planetary gear train 5 by flowing through the valleys 43 in the ring gear teeth 91 and between the small radial gap between the planetary gear support members 77 or washers 79 and the ring gear teeth. After exiting the last stage of planetary gearing, the cleaning fluid 3' flows into an annular outlet manifold 53 formed by a relief in the front face of the rear bearing housing 34. From the outlet manifold 53, the cleaning fluid 3' is directed to a series of four axially oriented holes 45 extending through the rear bearing housing 34. From the holes 45, the now somewhat heated cleaning fluid 3' flows axially so as to return to the passage 30, specifically, the portion of the passage 30 formed between the stem 87 and the output drive shaft 36.

Note that since the inlet passages 41 and outlet passages 45 of the planetary gear train cooling flow path are located between the cleaning fluid inlet 14 and the discharge nozzles 12, and the inlet passages 41 are disposed upstream of the outlet passages 45 with respect to the main cleaning fluid passage 30, there is ample pressure drop available to ensure an adequate flow of cleaning fluid 3' through the planetary gear train.

Since the ring gear 44 is disposed within the intermediate portion of the passage 30, cleaning fluid 3 flows over the ring gear so as to absorb a portion of the heat generated within the planetary gear train 5. Moreover, by flowing directly through the planetary gear train 5 and over the planetary gears 97 and sun gears 78 and 93, the diverted portion 3' of the cleaning fluid cools and lubricates the planetary gear train 5. Preferably, the amount of cooling and lubrication is sufficient so that oil-based lubricants, such as grease, or other lubricants considered to be contaminants with respect to sanitary products, such as lithium grease, need not be used in the planetary gear train 5. Most preferably, no oil-based or other lubricants considered to be contaminants with respect to sanitary products would be used anywhere in the cleaning machine.

In order to accommodate any reduction in lubrication and cooling associated with using cleaning fluid as essentially the exclusive cooling and lubrication medium, all of the components of the cleaning machine are preferably made of materials that will not rust or corrode when exposed to cleaning fluid. Most preferably, except for bushings and seals, the entire cleaning machine is made from stainless steel alloys. In one embodiment of the invention, the portions of the machine that are more highly loaded—such as the sun 78, 93 and planetary gears 97, the shafting 36, 76, 80, the planetary gear support members 77, the ring gear 44, etc.—are made from 17-4 PH stainless steel heat treated to H-900. Other, more lightly loaded components—such as the washers 75, 79—are made from 316 stainless steel.

The present invention may be embodied in other specific forms without departing from the spirit or essential attributes thereof and, accordingly, reference should be made to the appended claims, rather than to the foregoing specification, as indicating the scope of the invention.

What is claimed:

1. An apparatus for cleaning the interior of a vessel by ejecting a rotating stream of cleaning fluid, comprising:

a) a first fluid inlet for receiving said cleaning fluid;

b) a rotatable housing mounted for rotation about a first axis, c) a nozzle having a first fluid outlet for ejecting said cleaning fluid received by said first fluid inlet, said nozzle rotatably mounted on said rotatable housing so that said nozzle rotates about a second axis, a first fluid passage placing said first fluid inlet in fluid flow communication with said first fluid outlet;

d) an input shaft driven by said cleaning fluid received by said first fluid inlet;

e) a planetary gear train comprising a sun gear and at least one planetary gear mounted for rotation about said sun gear, said planetary gear train driven by said input shaft, said planetary gear train driving said rotatable housing to rotate about said first axis;

f) a housing at least partially enclosing said planetary gear train, a second fluid passage formed within said housing, said sun gear and said planetary gear disposed within said second fluid passage, said second fluid passage having a second fluid inlet and a second fluid outlet that together place said second fluid passage in flow communication with said first fluid passage, wherein at least a portion of said cleaning fluid received by said first fluid inlet flows through a portion of said first fluid passage and then flows into said second fluid inlet and then flows through said second fluid passage so as to flow over said sun gear and said planetary gear and then flows through said second fluid outlet so as to reenter said first fluid passage and then flows through said first fluid outlet.

2. The cleaning apparatus according to claim 1, wherein said second fluid passage comprises an initial passage portion disposed adjacent said second fluid inlet, said initial portion of said second fluid passage being approximately radially oriented, whereby said portion of said cleaning fluid flows approximately radially inward through said initial portion of said second fluid passage after flowing through said second fluid inlet.

3. The cleaning apparatus according to claim 2, wherein at least a portion of said first fluid passage is approximately axially oriented, said second fluid inlet being formed in said axially oriented portion of said first fluid passage, whereby said portion of said cleaning fluid turns approximately radially inward in order to flow from said first fluid passage into said second fluid inlet of said second fluid passage.

4. The cleaning apparatus according to claim 2, wherein said second fluid passage further comprises an intermediate passage portion disposed adjacent said initial passage portion, said sun gear and said planetary gears are disposed in said intermediate portion of said second fluid passage.

5. The cleaning apparatus according to claim 1, wherein said second fluid passage comprises initial, intermediate and final portions, and wherein (i) said initial portion of said second fluid passage is disposed adjacent said second fluid inlet and is approximately radially oriented, whereby said portion of said cleaning fluid flows approximately radially inward from said first fluid passage into said second fluid inlet and the flows approximately radially inward through said initial portion of said second fluid passage, (ii) said sun gear and said planetary gears are disposed in said intermediate portion of said second fluid passage, and (iii) said final portion of said second fluid passage is disposed adjacent said second fluid outlet and is approximately axially oriented, whereby said portion of said cleaning fluid flows approximately axially outward from said second fluid passage through said second fluid outlet and then into said first fluid passage.

6. The cleaning apparatus according to claim 1, wherein said planetary gear train sousing is disposed within said first passage, whereby said cleaning fluid flows over said planetary gear train housing.

7. The cleaning apparatus according to claim 1, wherein said planetary gear train is disposed between said first fluid inlet and said first fluid outlet.

8. The cleaning apparatus according to claim 1, wherein said second fluid inlet is disposed at a first location along said first fluid passage, second fluid outlet is disposed at a second location along said first fluid passage, said second location being downstream from said first location with respect to flow of said cleaning fluid through said first fluid passage.

9. The cleaning apparatus according to claim 1, wherein said planetary gear housing comprises a cylindrical ring gear having a plurality of teeth formed around the inside diameter thereof.

10. The cleaning apparatus according to claim 9, wherein each pair of adjacent teeth in said ring gear form a valley therebetween, wherein a portion of said second fluid passages is formed by said valleys.

11. The cleaning apparatus according to claim 1, wherein said sun gear, said planetary gear, and said planetary gear housing are made from stainless steel.

12. The cleaning apparatus according to claim 1, wherein said second axis is perpendicularly oriented with respect to said first axis.

13. An apparatus for spraying a cleaning fluid for cleaning the interior of a vessel used for containing a sanitary product that minimizes the possibility of oil-based lubricants contaminating said cleaning fluid, comprising a) a stationary assembly, said stationary assembly forming a first fluid inlet for receiving said cleaning fluid, a first gear affixed to said stationary assembly;

b) a first rotatable housing mounted for rotation about a first axis, a first fluid outlet formed in said first rotatable housing for ejecting said cleaning fluid received by said first fluid inlet, a second gear affixed to said first rotatable housing and engaging said first gear;

c) a second rotatable housing, said second rotatable housing mounted for rotation about a second axis oriented substantially perpendicularly with respect to said first as, said first rotatable housing mounted on said second rotatable housing whereby rotation of said second rotatable housing about said second axis causes said first rotatable housing to also rotate about said second axis, said engagement of said first and second gears causing said first gear to drive rotation of said first rotatable housing about said first axis when said first rotatable housing rotates about said second axis, d) a first fluid passage extending through sad stationary assembly and said first and second rotatable housings so as to place said first fluid inlet in fluid flow communication with said first fluid outlet;

e) a rotatable impeller disposed in said stationary assembly so as to be driven by said cleaning fluid flowing through said first fluid inlet;

f) a planetary gear train driven by said impeller, said planetary gear train driving said rotation of said second rotatable housing about said second axis, said planetary gear train comprising a sun gear and at least one planetary gear mounted for rotation about said sun gear;

g) a second fluid passage extending through said planetary gear train and in flow communication with said first fluid passage, whereby a portion of said cleaning fluid flowing through said first fluid passage flaws Trough said second fluid passage, said planetary gear train being lubricated solely by said portion of said cleaning fluid flowing therethrough.

14. The cleaning apparatus according to claim 13, wherein said planetary gear train comprises a gear train housing enclosing said planetary gear train, at least a portion of said second fluid passage extending through said gear train housing.

15. The cleaning apparatus according to claim 14, wherein said gear train housing comprises a ring gear.

16. The cleaning apparatus according to claim 14, wherein an initial portion of said portion of said second fluid passage extending through said gear train housing is approximately radially oriented.

17. The cleaning apparatus according to claim 14, wherein said first rotatable housing comprises a nozzle, and wherein said first fluid outlet is formed by said nozzle.

18. A method of cleaning a vessel suitable for containing a sanitary product, comprising the steps of:

a) introducing a cleaning machine into said vessel, b) introducing a flow of clean fluid into an inlet of said cleaning machine;

c) rotating an impeller by directing said cleaning fluid to flow over said impeller so that said impeller drives rotation of a planetary gear train, said planetary gear train driving rotation of a rotatable body housing about a first axis, said rotatable body housing driving rotation of a rotatable nozzle housing about a second axis;

d) directing said flow of cleaning fluid received by said inlet through a passage to a nozzle mounted on said rotatable nozzle housing so that said nozzle rotates with said rotatable nozzle housing;

e) ejecting said cleaning fluid from said nose, f) cooling and lubricating said planetary gear train by diverting a portion of said flow of cleaning fluid from said passage so as to cause said portion of said cleaning fluid to flow through said planetary gear train and then reintroducing said portion of said cleaning fluid back into said passage so that said reintroduced portion of said cleaning fluid is then ejected from said nozzle.

* * * * *

UNITED STATES PATENT AND TRADEMARK OFFICE

CERTIFICATE OF CORRECTION

PATENT NO. : 6,561,199 B2
DATED : May 13, 2003
INVENTOR(S) : Bentley F. Gleeson et al.

It is certified that error appears in the above-identified patent and that said Letters Patent is hereby corrected as shown below:

Column 2,
Line 19, delete “fiat” and insert -- first --.

Column 6,
Line 4, delete “Aft” and insert -- After --.
Line 19, insert -- . -- after “12”.
Line 23, delete “flaw” and insert -- flow --.

Column 9,
Line 2, delete “as,” and insert -- axis, --.
Line 10, delete “sad” and insert -- said --.
Line 26, delete “nose” and insert -- nozzle --.
Line 27, delete “flaws” and insert -- flows --.

Signed and Sealed this

Fifteenth Day of July, 2003

JAMES E. ROGAN
*Director of the United States Patent and Trademark Office*